US009333629B2

(12) United States Patent
Chen

(10) Patent No.: US 9,333,629 B2
(45) Date of Patent: May 10, 2016

(54) REVERSIBLE RATCHET WRENCH

(71) Applicant: Wei-Chu Chen, Yunlin (TW)

(72) Inventor: Wei-Chu Chen, Yunlin (TW)

( * ) Notice: Subject to any disclaimer, the term of this patent is extended or adjusted under 35 U.S.C. 154(b) by 249 days.

(21) Appl. No.: 14/081,148

(22) Filed: Nov. 15, 2013

(65) Prior Publication Data

US 2015/0135909 A1 May 21, 2015

(51) Int. Cl.
*B25B 13/46* (2006.01)

(52) U.S. Cl.
CPC ..... *B25B 13/463* (2013.01)

(58) Field of Classification Search
CPC ..... B25B 13/463
USPC ..... 81/63, 63.2
See application file for complete search history.

(56) References Cited

U.S. PATENT DOCUMENTS 3,019,682 A * 2/1962 Hare ..... B25B 13/463 192/43
7,121,170 B2 * 10/2006 Shen ..... B25B 13/463 81/58
8,763,498 B2 * 7/2014 Hsieh ..... B25B 13/463 192/43.2
8,770,066 B2 * 7/2014 Chang ..... B25B 13/463 81/63

* cited by examiner

*Primary Examiner* — Hadi Shakeri
(74) *Attorney, Agent, or Firm* — Che-Yang Chen; Law Offices of Scott Warmuth

(57) ABSTRACT

A novel reversible ratchet wrench may include a wrench body, a control member, a ratchet member and a rotating member, wherein the control member has a restricting slot and two stopper planes, and a deep hole for placing the spring. The control member is placed into the round hole of the wrench body by the half cylindrical body and connects with the ratchet member which is placed into the arc-shaped ratchet slot, thereby resulting in a secure relative positioning between the control member and the ratchet member. The novel reversible ratchet wrench allows convenient switch between directions of the rotational movement of the wrench body and the structural design effectively prevents the spring from ejecting from the deep hole of the control member or getting stuck by restricting the movement space of the spring. Furthermore, this structural design improves the smoothness of switching operation of the ratchet wrench.

5 Claims, 12 Drawing Sheets

REVERSIBLE RATCHET WRENCH

FIELD OF INVENTION

The present invention relates to a ratchet wrench, more specifically to a durable and flexible reversible ratchet wrench.

BACKGROUND OF THE INVENTION

As illustrated in FIG. 12, a conventional ratchet wrench 50 comprises a rotating member 60, which can be rotated at the end of the wrench 50 and therefore to screw tight or loosen the nuts or bolts. The outer surface of the rotating member 60 is a ring gear structure 61, and the ring gear structure 61 intermeshes with the arc-shaped toothed surface of the ratchet member 70. The ratchet member 70 has on the other side an arc-shaped smooth surface 71 and can be operated within the space of the first chamber 51 of the wrench 50. The wrench has a second chamber 52 which is connected to the first chamber 51, and the second chamber 52 is installed with a control block 80. The control block 80 has an opening 81 at the end that faces the ratchet member 70, and a spring 82 is placed into the opening 81, with a spring cap 83 that covers the portion of the spring 82 that protrudes out from the opening 81. The spring cap 83, as being pushed by the compressed spring 82, pushes against the arc-shaped surface 71 of the ratchet member 70. By operating the control block 80 the places of the arc-shaped surface 71 to be pushed by the spring cap 83 may be selected, and the ratchet member 70 can thus be placed to the desired side of the first chamber 51, thereby allowing unidirectional rotational movement of the wrench 50.

The above-mentioned conventional ratchet wrench has the following structural deficiencies:

(a) As previously described, the spring 82 and the spring cap 83 are interposed between the ratchet member 70 and the control block 80, and the spring cap 83, as is pushed by the spring 82, pushes against the arc-shaped surface of the ratchet member 70. Therefore, when the wrench 50 is being rotated or when the control block 80 is being adjusted, the tip of the spring cap 83 pushes against and slides along the arc-shaped surface 71 of the ratchet member 70 and the other end of the spring cap 83 chafes laterally against the inner wall of the opening 81 of the control block 80, which may likely cause the spring 82 and the spring cap 83 to eject out from the opening or become deformed, and may also result in resistance force that reduces the operational stability of the conventional ratchet wrench. The conventional ratchet wrench thus is insufficient in structural strength and also may not allow smooth operation.

(b) The ratchet wrench 50 is installed following the procedures listed below: Firstly, the control block 80 is placed into the second chamber 52, and fixed by fastening steps to allow only the rotational movement of the control block 80. Secondly, the spring 82 is inserted into the opening 81 from the space of the first chamber 51, with the end of the spring 82 that protrudes out from the opening 81 enclosed into the spring cap 83. This installation step is rather difficult because the first chamber 51 opens towards the rotating member 60 and the space available for this installation step is limited and also because the spring 82 and the spring cap 83 are small in size they may get dropped or lost easily during the installation. Thirdly, it is necessary to place another spring 84 which also limits the positioning of the control block 80, and this additional step further increases the level of difficulty of the installation process, and likely causes excessive loss of components that are difficult to be manufactured.

(c) The spring 82 and the spring cap 83 is interposed between the ratchet member 70 and the control block 80, and the spring cap 83, as being pushed by the spring 82 within the spring cap 83, pushes against and slides along the arc-shaped surface 71 of the ratchet member 70. When ratchet member 70 is being moved, the spring cap 83 also pushes and compresses the spring 82, and this pushing maintains the space between the ratchet member 70 and the control block 80 for the movement of the ratchet member 70. During the movement of the ratchet member 70 within the first chamber 51, excessive portion of the spring cap 83 and the spring 82 may protrude out of the opening 81, which reduces the positioning effect on the spring 82 and the spring cap 83 therefore the spring 82 may eject out from the opening, get damaged, or get stuck. These deficiencies cause problems in practical uses thus further improvements are required.

The present invention provides a novel improved reversible ratchet wrench which solves the above-mentioned problems. The novel reversible ratchet wrench was developed as a result of the extensive research and is suitable for practical uses.

SUMMARY OF THE INVENTION

The present invention relates to a novel reversible ratchet wrench that solves the above-mentioned problems.

The novel reversible ratchet wrench of the present invention comprises a ratchet portion at the working end of the wrench, and the ratchet portion has an operation opening and a round hole. In addition, there is an arc-shaped ratchet slot between the operation opening and the round hole for placing the ratchet member. The wrench also has a control member which has a shaft portion, with a round plate attached to the front end of the shaft portion. The round plate extends downwards to form a half cylindrical column which is interposed into the round hole of the wrench body. The half cylindrical column has two stopper planes that extend towards the ratchet member and both are parallel to the round plate, and a restricting slot that is formed between those two stopper planes. There is a deep hole into the body of the half cylindrical column corresponding to the location of the restricting slot, wherein a spring is placed into the deep hole, with the first stopper plane, the second stopper plane, and the spring all face towards the arc-shaped ratchet slot. The ratchet member has on one side an arc-shaped ring gear structure that is inwardly curved and faces the operation opening, and on the other side an arc-shaped smooth surface which may slide against the inner surface of the arc-shaped ratchet slot. The center area of the smooth surface of ratchet member is carved to leave two slots, with the first slot that may open through the top surface of the ratchet member, and a restricting block left bulged between these two slots. When the reversible ratchet wrench is assembled the restricting block of the ratchet member is interposed into the restricting slot of the control member, the first stopper plane of the control member is placed into the first slot of the ratchet member, and the second stopper plane of the control member is placed into the second slot of the ratchet member, thereby resulting in the proper restricted positioning of the control member and the ratchet member. The restricting block of the ratchet member is recessed and is pushed against by the end of the spring that protrudes out from the deep hole. Furthermore, a rotating member is placed into the operation opening of the reversible ratchet wrench, and the rotating member is a cylindrical body with a hollow center and has a toothed ring gear structure located at the outer surface of the cylindrical body, and the ring gear structure may intermesh with the arc-shaped toothed surface of the ratchet member when the ratchet member is being pushed by the spring.

Furthermore, the operation opening of the above mentioned novel reversible ratchet wrench has a fixing slot at the top edge of the inner surface of the operation opening, and the rotating member has a concaved slot at the corresponding place located at the outer surface of the cylindrical body of the rotating member, wherein a C-shaped elastic fastening member can be fitted into both slots and therefore secure the connection between the rotating member and the wrench body.

Furthermore, the restricting block of the ratchet member has two symmetrical recessed surfaces that face towards the control member and can be pushed against by the spring, and the direction of the rotational movement of the wrench body may be determined by selecting either one of the two symmetrical surfaces to be pushed against by the spring.

Furthermore, the restricting block of the ratchet member has an arc-shaped convex surface between the two symmetrical recessed surfaces, which functions to increase the speed of the switching operation between the two different directions of the rotational movement of the wrench body.

Furthermore, the restricting block of the ratchet member has two additional stopper planes with one located to the outer side of each of the two symmetrical recessed surfaces, which further enhances the position limiting effect to the spring.

The novel reversible ratchet wrench has multiple advantages as the result of the above-mentioned structural characteristics and technical improvements. The first major advantage of the novel reversible ratchet wrench of the present invention is the structural design that allows proper position of the control member, the ratchet member, especially the spring. As above describes, the control member has a restricting slot, the first and the second stopper planes located at both sides of the restricting slot, and a deep hole that is located in the body of the half cylindrical column between the first and the second stopper planes and with an opening towards the restricting slot for securely placing the spring. Furthermore, when the cylindrical column of the control member is properly inserted into the round hole of the wrench body, the ratchet member is interposed into the arc-shaped ratchet slot, the restricting block of the ratchet member is placed into the restricting slot of the ratchet member, and the first and second stopper planes are placed into the first and second slots, respectively. This structural design not only secures the proper positioning of the control member and the ratchet member, but also effectively prevents the spring from ejecting out from the deep hole in the half cylindrical body of the control member or getting stuck by restricting the movement of the spring through positioning the spring within the space enclosed by the first and the second stopper planes of the control member and the two recessed surfaces located on the restricting block of the ratchet member. Furthermore, this structural design also improves the smoothness of the switching operation between directions of the rotating movement of the wrench body. Therefore, the novel reversible ratchet wrench (II) of the present invention is durable and flexible for practical uses.

The second major advantage of the novel reversible ratchet wrench of the present invention is that the installation process in simple and convenient. The wrench body has a round hole, an arc-shaped ratchet slot, and an operation opening, wherein the control member as well as the spring is interposed into the round hole. The positioning of the control member is achieved by the installation of the ratchet member. Furthermore, the installation of the C-shaped fastening member into the concaved slot of the rotating member and the fixing slot of the wrench body connects the rotating member to the wrench body. Therefore the structural design of the novel reversible ratchet wrench of the present invention allows quick and convenient installation of the components, reduces the number of components required, and simplifies the manufacturing processes of these components.

The third major advantage of the novel reversible ratchet wrench (II) of the present invention is that the restricting block has two symmetrical recessed surfaces that face towards the control member, thereby the unidirectional rotational movement of the wrench body can be readily achieved by selecting one of the two surfaces against which the spring pushes. Furthermore, the restricting block of the ratchet member has an arc-shaped convex surface between the two symmetrical recessed surfaces, which functions to increase the speed of the switching operation between directions of rotational movement of the wrench body as the spring slides at an accelerated speed towards the recessed surface after it passes the arc-shaped convex surface. Furthermore, this design also increases the smoothness of the switching operation between directions of rotational movement of the wrench body.

The fourth major advantage of the novel reversible ratchet wrench of the present invention is that the restricting block of the ratchet member may also have two stopper planes with one stopper plane located at the further outer side of each of the two symmetrical recessed surfaces. These stopper planes also function to enhance the position limiting effect to the spring.

Other advantages of the novel reversible ratchet wrench of the present invention will be illustrated in the figures and described in the following detailed description of the present invention.

DETAILED DESCRIPTION OF THE INVENTION

The structural characteristics, technical improvements, functioning mechanisms, and major advantages of the novel reversible ratchet wrench of the present invention will be described in detail with the reference to corresponding figures.

Figure 1:
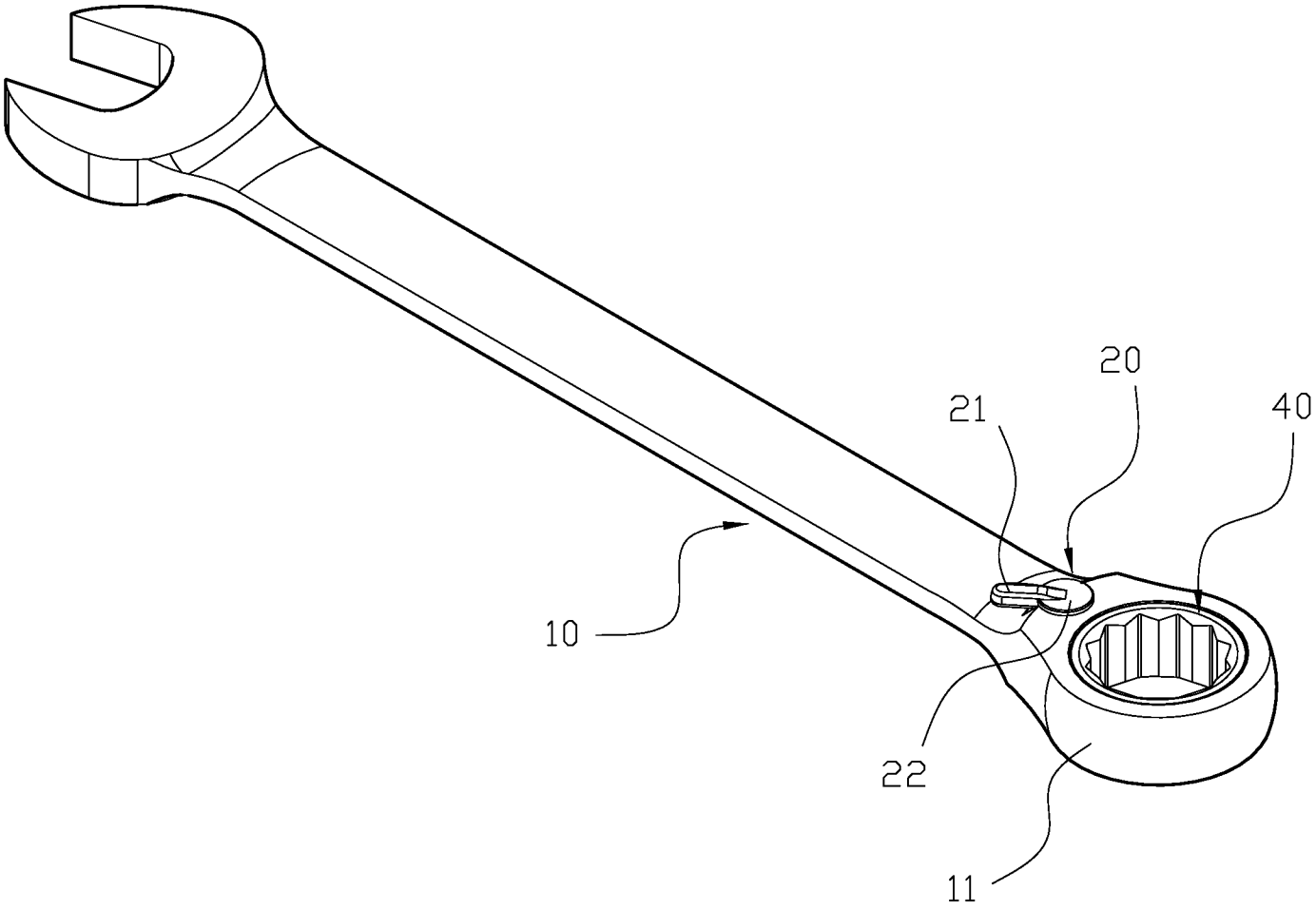
FIG. 1 is a perspective view of the novel reversible ratchet wrench of the present invention.
Figure 2:
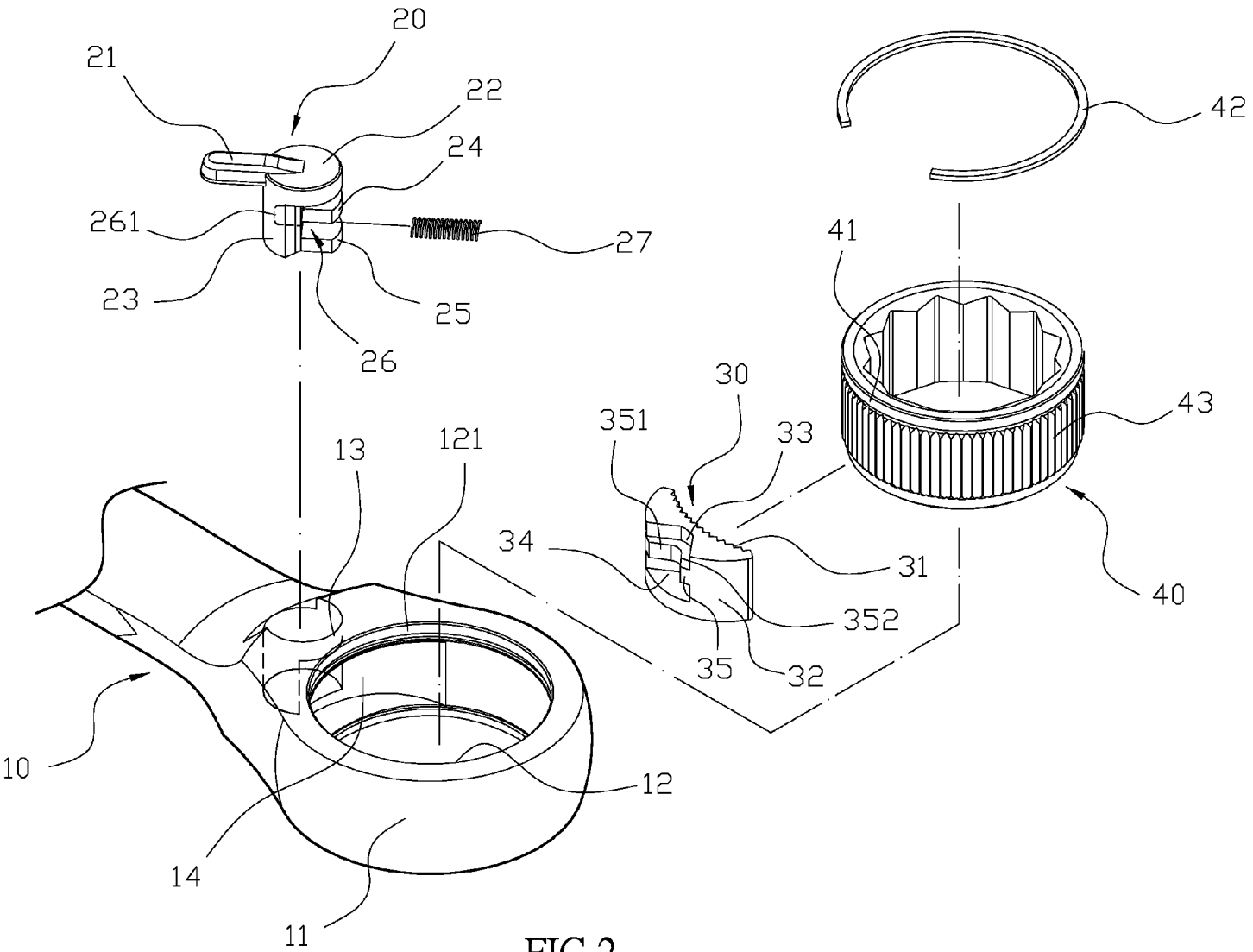
FIG. 2 is a three-dimensional perspective view of the novel reversible ratchet wrench of the present invention.
Figure 3:
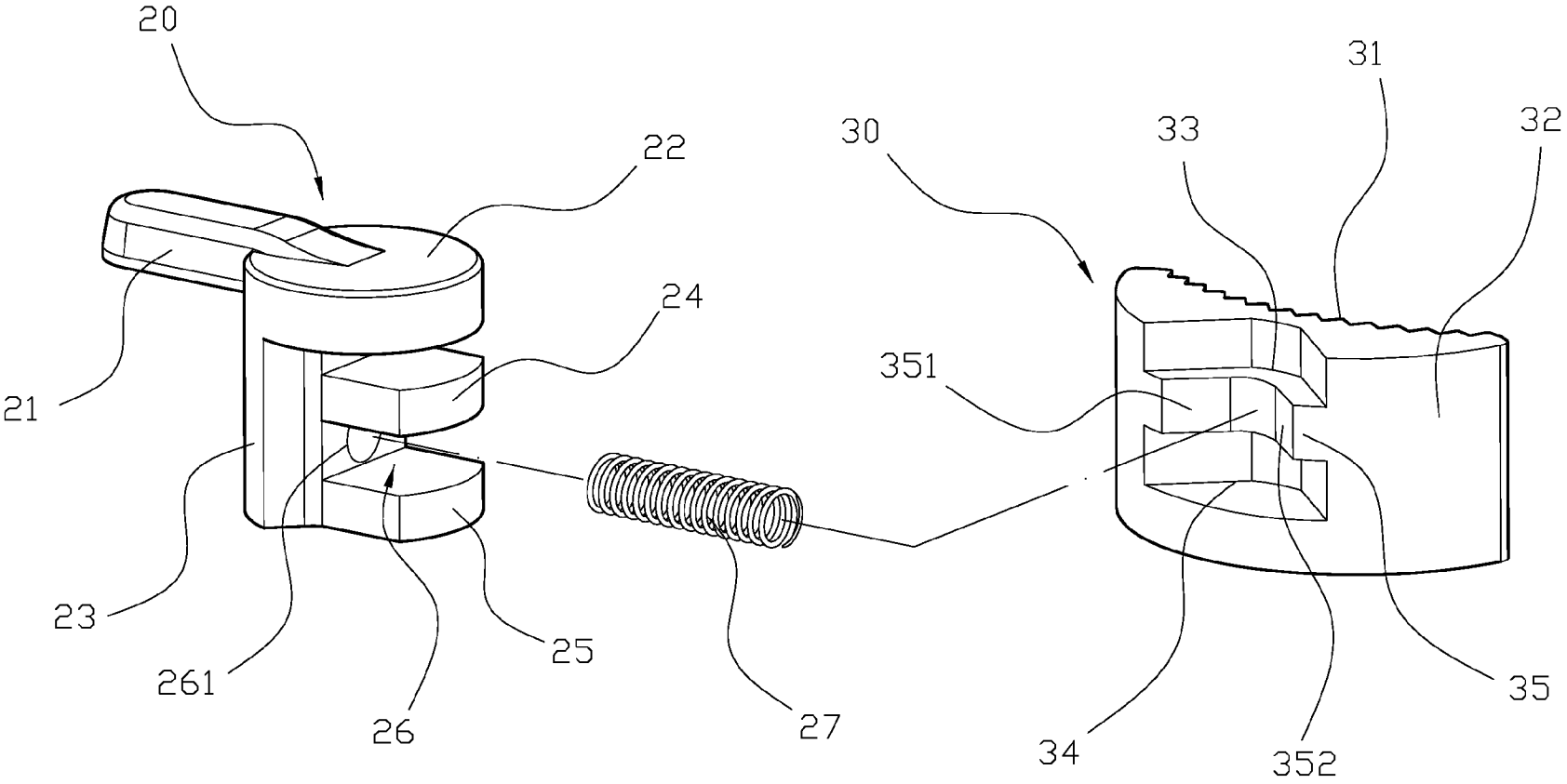
FIG. 3 is an exploded perspective view of control member and the ratchet member of the present invention.
Figure 4:
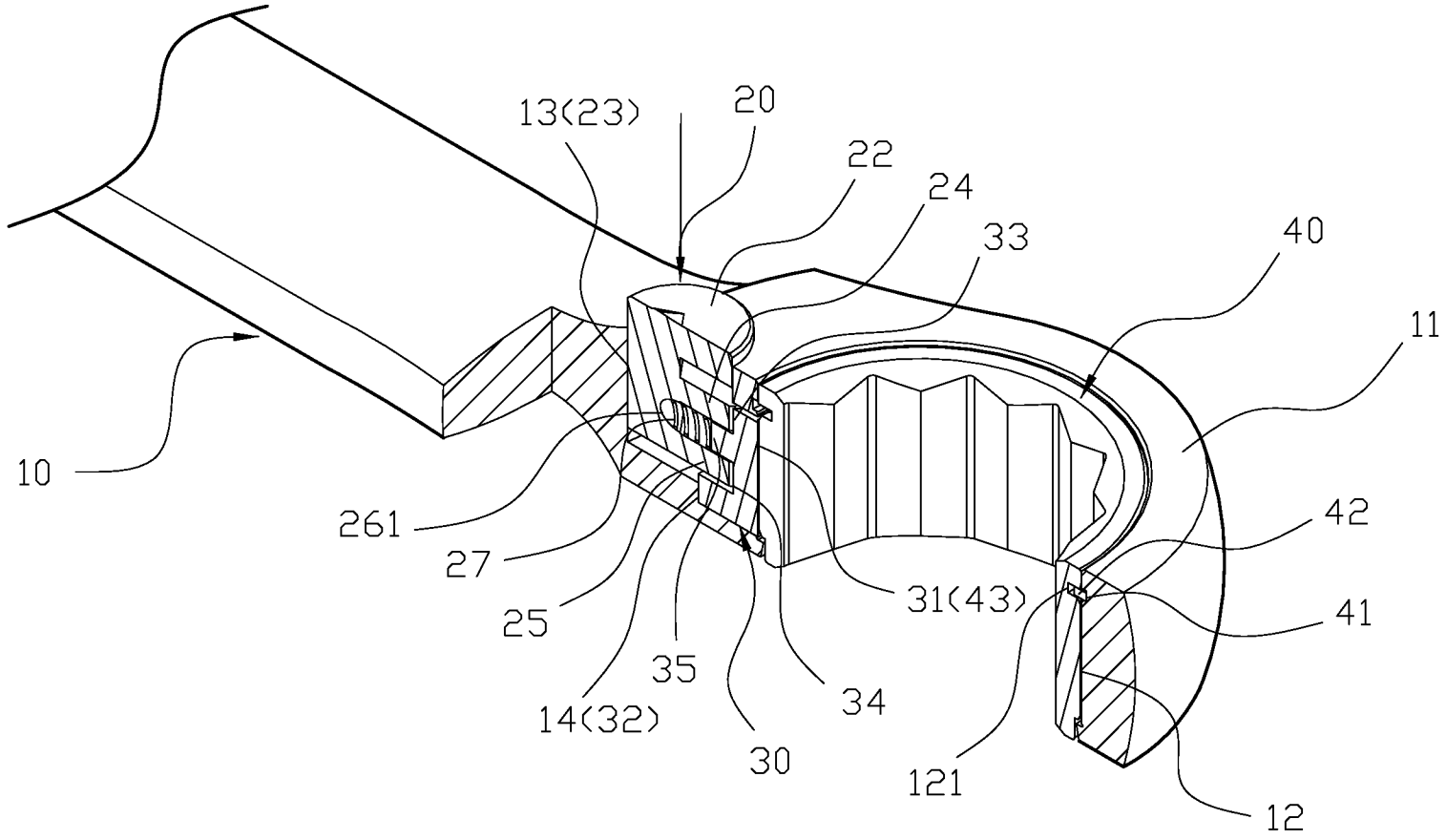
FIG. 4 is sectional view of a part of the novel reversible ratchet wrench of the present invention.
Figure 5:
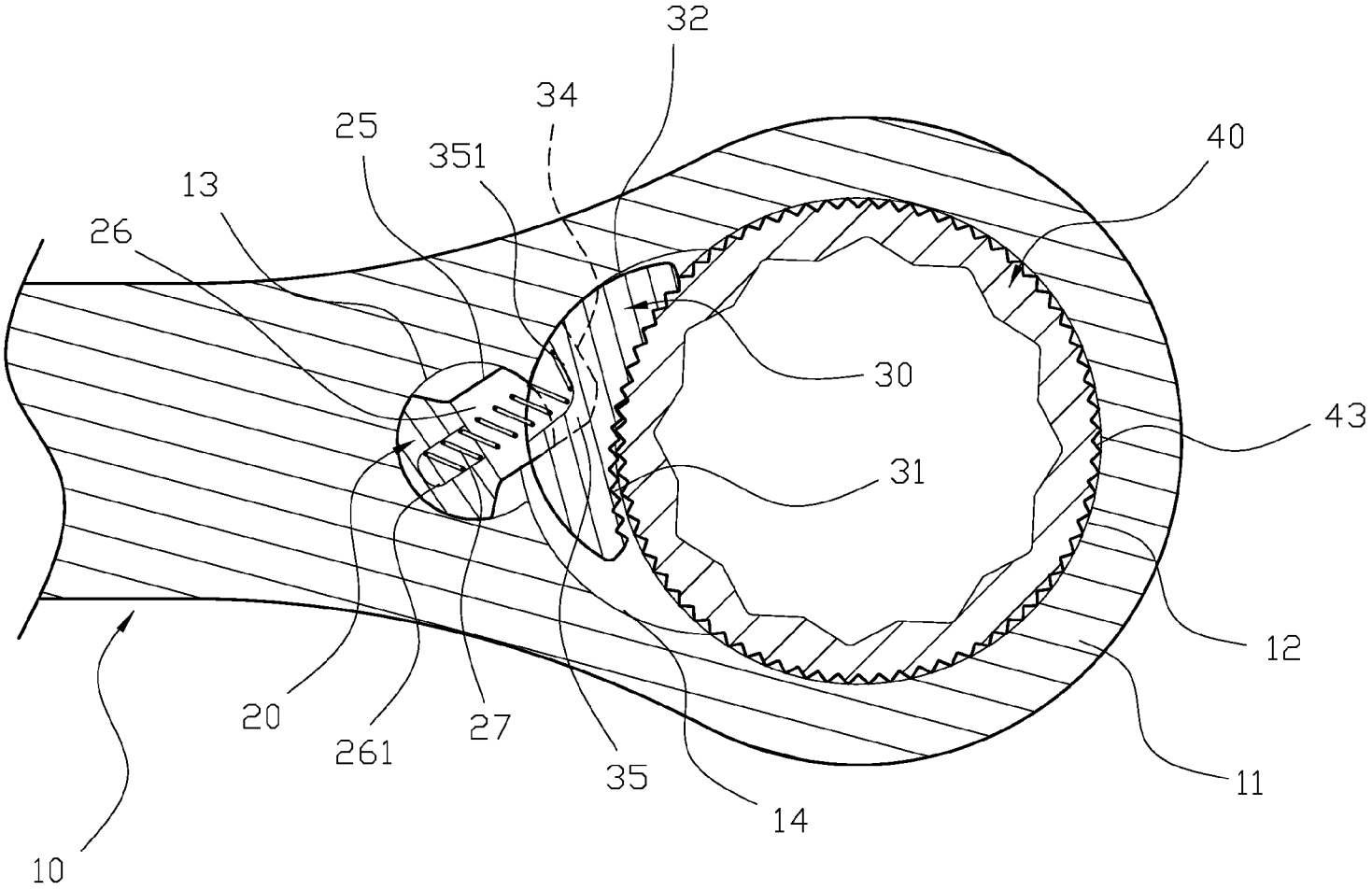
FIG. 5 is a first illustration of the present invention when the control member pushes against the ratchet member in clockwise direction.

As illustrated in FIGS. 1 to 3, the novel reversible ratchet wrench of the present invention comprises a wrench body 10, a control member 20, a ratchet member 30, and a rotating member 40. The ratchet portion 11 is located at one end of the wrench body 10, which has an operation opening 12 and a round hole 13 wherein the operation opening 12 and the round hole 13 are connected via an arc-shaped ratchet slot 14. In addition, a fixing slot 121 is located at the top edge of the inner surface of the operation opening 12 of the wrench body 10. The control member 20 has a shaft portion 21, and a round plate 22 that is attached to the front end of the shaft portion 21. The round plate 22 is extended downwards to form a half cylinder 23, and the half cylinder 23 fits and is to be inserted into the round hole 13 of the wrench body 10. The half cylinder 23 has two stopper planes that protrude towards the ratchet member and both are parallel to the round plate 22, namely the first stopper plane 24 and the second stopper plane 25. A restricting slot 26 is therefore formed between the first stopper plane 24 and the second stopper plane 25, and a deep hole 261 is present in the body of the half cylinder 23 of the control member 20 at the position corresponding to the restricting slot 26. A spring 27 is placed into the deep hole 261, with the first stopper plane 24, the second stopper plane 25, and the spring 27 all point towards the arc-shaped ratchet slot 14. A ratchet member 30 has on one side an inwardly curved arc-shaped toothed surface 31 and on the other side an outwardly curved smooth surface 32, which allows the ratchet member 30 to slide with its smooth surface 32 against the arc-shaped ratchet slot 14. Furthermore, the center portion of the smooth surface 32 of the ratchet member 30 is carved to form a first slot 33 and a second slot 34, which are separated by a bulged restricting block 35. When the reversible ratchet wrench is installed, the restricting block 35 of the ratchet member 30 is placed into the restricting slot 26 of the control member 20, the first stopper plane 24 of the control member 20 is placed into the first slot 33 of the ratchet member 30, and the second stopper plane 25 is placed into the second slot 34 of the ratchet member 30, thereby achieving the appropriate relative positioning of the control member 20 and the ratchet member 30. Furthermore, the restricting block 35 of the ratchet member 30 is recessed and is pushed against by the end of the spring 27 that protrudes out from the opening 261. There are two symmetrical recessed surfaces 351/352 located on the restricting block 35, and either of these two symmetrical recessed surfaces 351/352 may be selected for being pushed against by the spring 27 to achieve the unidirectional rotational movement of the wrench body 10. A rotating member 40, which is a cylindrical body with a hollow center, is installed into the operation opening 12 of the wrench body 10, and the rotating member 40 has a concaved slot 41 at the top edge of the outer surface of its cylindrical body. When the reversible ratchet wrench is installed, a C-shaped elastic fastening member 42 can be fitted into the concaved slot 41 of the rotating member 40 and the fixing slot 121 of the operation opening 12, thereby securing the connection between the rotating member 40 and the wrench body 10. In addition, the outer surface of the rotating member 40 has a ring gear structure 43 with toothed surface, which may intermesh with the inwardly curved toothed surface 31 of the ratchet member 30 when the ratchet member 30 is being pushed by the spring 27 to resist against the rotating member 40.

The installation process of the novel reversible ratchet wrench is described in detail as below, referring to FIGS. 1 to 5. The spring 27 is placed into the deep hole 261 in the half cylindrical body 23 of the control member 20, with a portion of the spring 27 protrudes out from the deep hole 261, and the positioning of the protruding portion of the spring 27 is limited by the first stopper plane 24 and the second stopper plane 25 located at both sides of the restricting slot 26. The control member 20 is then installed by placing the half cylinder 23 into the round hole 13 of the wrench body 10, and aligning the first stopper plane 24, the second stopper plane 25, and the spring 27 to all pointing towards the arc-shaped ratchet slot 14. The ratchet member 30 is then placed into the arc-shaped ratchet slot 14 from the operation opening 12, and is appropriately positioned by placing the restricting block 35 of the ratchet member 30 into the restricting slot 26 of the control member 20, the first stopper plane 24 into the first slot 33 of the ratchet member 30, and the second stopper plane 25 of the control member 20 into the second slot 34 of the ratchet member 30. In this way the control member 20 may not detach away from the wrench body 10, and may only rotate when the shaft portion 21 of the control member 20 is being operated. In addition, the end of the spring 27 that protrudes out from the deep hole 31 is placed against the recessed restricting block 35 of the ratchet member 30. The positioning of the spring 27 is therefore further secured by being enclosed by the two symmetrical recessed surfaces 351/352 of the ratchet member 30, in addition to the first stopper plane 24 and the second stopper plane 25 of the control member 20, which effectively prevents the spring 27 from ejecting out from the deep hole 261 of the control member 20, or bending, or getting stuck. The rotating member 40 is then placed into the operation opening 12 of the wrench body 10, and by applying the C-shaped elastic fastener member 43 to connect the fixing slot 121 located in the wrench body 10 and the recessed slot 41 located in the outer surface of the rotating member 40 to achieve the secure connection between the rotating member 40 and the wrench body 10. This connection method allows the toothed outer surface of the ring gear structure 43 of the rotating member 40 to intermesh with the inwardly curved toothed surface 31 of the ratchet member 30, and prevents the ratchet member 30 to detach from the operation opening 12. This thus completes the installation process.

Figure 6:
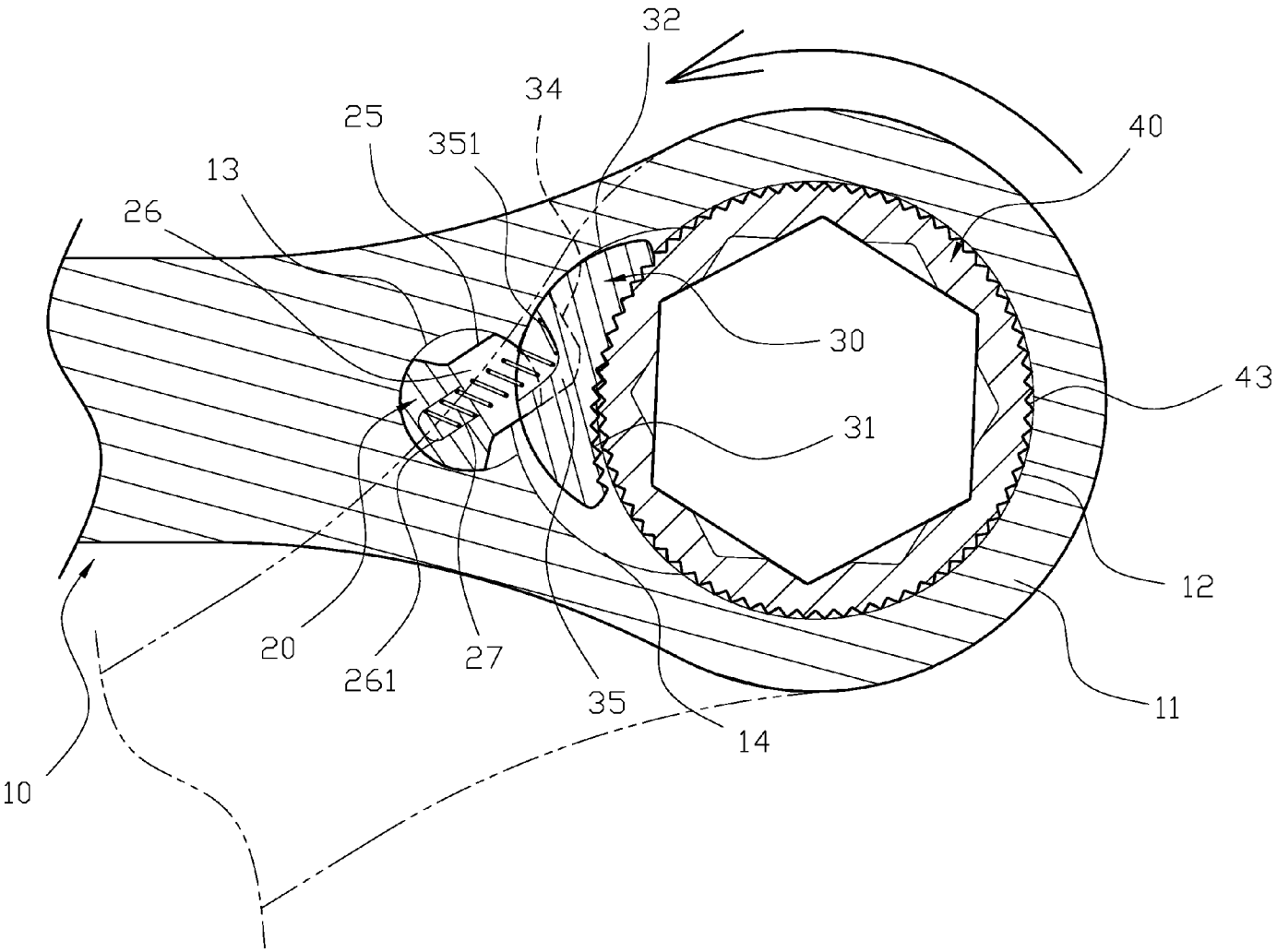
FIG. 6 is a second illustration of the present invention when the control member pushes against the ratchet member in clockwise direction.
Figure 7:
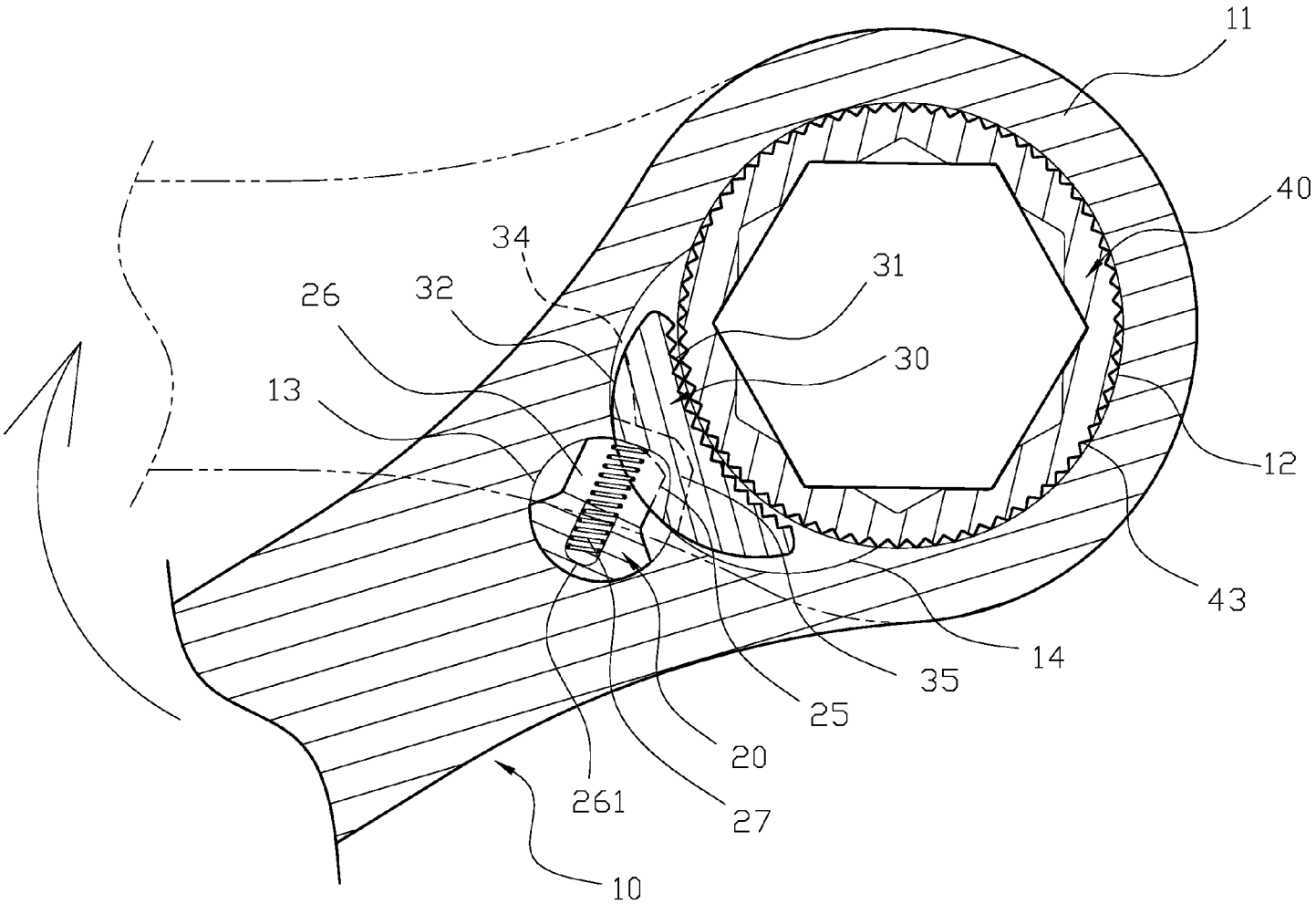
FIG. 7 is a third illustration of the present invention when the control member pushes against the ratchet member in clockwise direction.
Figure 8:
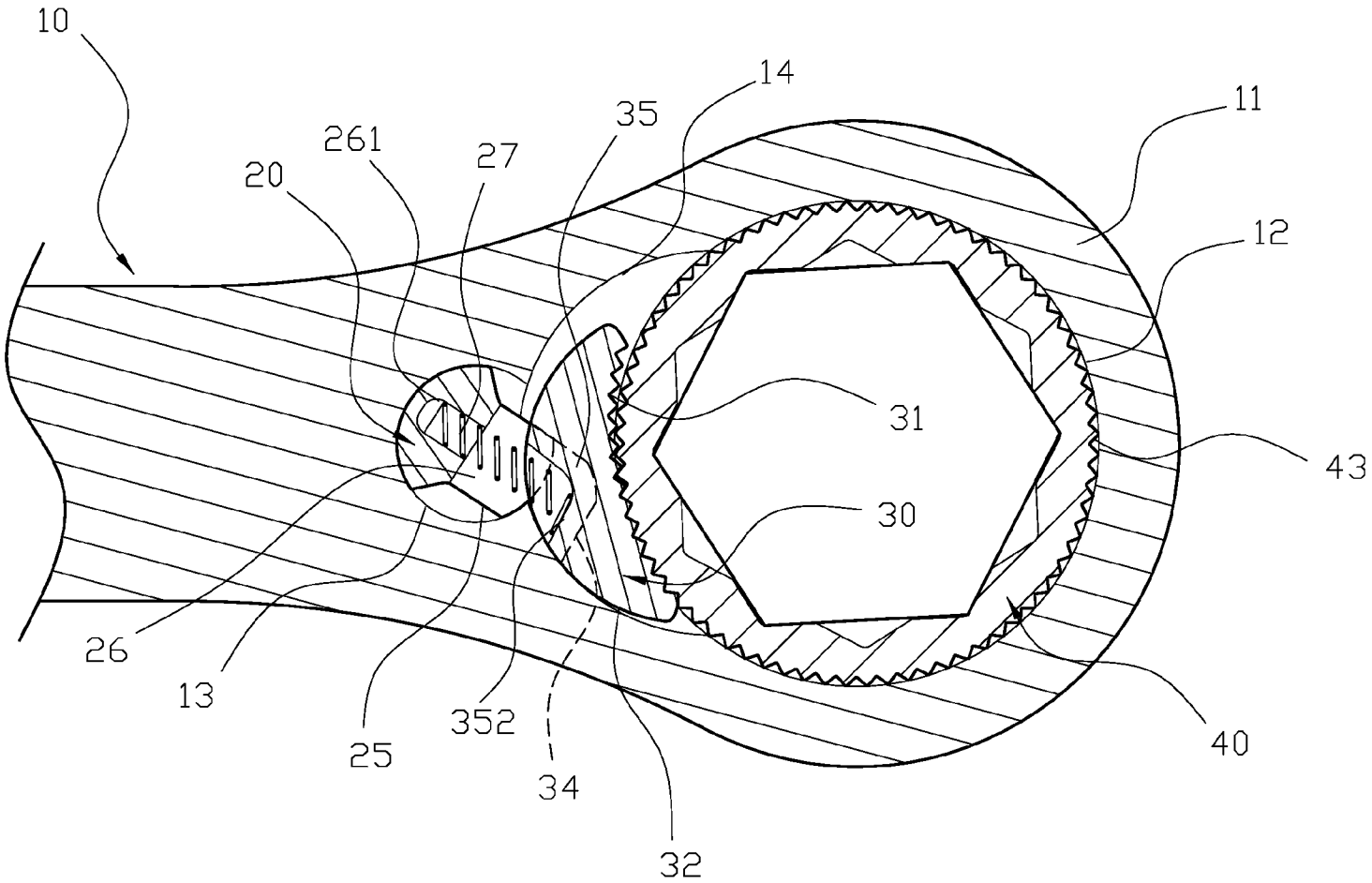
FIG. 8 is an illustration of the present invention when the control member pushes against the ratchet member in counter-clockwise direction.

The operation of the novel reversible ratchet wrench is described as below. Referring to FIGS. 6 and 7 as well as FIGS. 2 and 3, the spring 27 is placed into the deep hole 261 of the control member 20 and the end of the spring 27 that protrudes out pushes against the restricting block 35 of the ratchet member 30. Depending on the desired direction of the unidirectional rotational movement of the ratchet wrench body 10, the control member 20 may be rotated by operating the shaft portion 21 to allow the spring 27 to push against one of the symmetrical recessed surfaces 351 or 352. If the spring 27 pushes against the recessed surface 351, and this operation moves the ratchet member 30 to one side of the arc-shaped ratchet slot 14, therefore the arc-shaped toothed surface 31 of the ratchet member 30 becomes intermeshed with the toothed outer surface of the ring gear 43 of the rotating member 40. Under this condition, the spring 27 is placed between the first stopper plane 24 and the second stopper plane 25 of the control member 20, and the space of the restricting slot 26 of the control member 20 is also partially occupied by the restricting block 35 of the ratchet member 30, therefore the available space for the movement of the spring 27 is essentially limited, which prevents the spring 27 to deform or eject out of the deep hole 261 due to lateral applied thrust and as a result allows the reversible ratchet wrench of the present invention to operate reliably. When the control member 20 is switched to the position so that the spring 27 pushes against the recessed surface 351 of the restricting block 35 of the ratchet member 30 in the clockwise direction, rotating the wrench body 10 in the counter-clockwise direction results in the reaction force to be generated by the rotating member 40, wherein the ring gear 43 of the rotating member 40 then moves the toothed surface 31 of the ratchet member 30 in clockwise direction towards one end of the arc-shaped ratchet slot 14. In addition, the spring 27 also pushes and stops the ratchet member 30 to the side of the arc-shaped ratchet slot 14 pointed by the spring 27, thereby allowing the rotational movement the wrench body in the counter-clockwise direction to screw tight the nuts or bolts. Furthermore, when the wrench body 10 is rotated in clockwise direction, the reaction force generated by the rotating member 40 removes the stopping effect of the ring gear 43 on the movement of the ratchet member 30. In addition, as the other side of the arc-shaped ratchet slot 14 is empty and the spring 27 is increasingly compressed by the restricting block 35 of the moving ratchet member 30 as the positioning of the spring 27 is secured by the first stopper plane 24 and the second stopper plane 25, the ratchet member 30 slides towards the other side of the arc-shaped ratchet slot 14. These together lead to the separation of the rotating member 40 from the ratchet member 30, which allows the wrench body 10 to operate idly, and allows the locking effect to nuts or bolts limited only to the rotational movement of the wrench body 10 in one specific direction. As further illustrated in FIG. 8, when the control member 20 is switched to push against the ratchet member 30 in the counter-clockwise direction, the spring 27 pushes against the other recessed surface 352 on the restricting block 35 of the ratchet member 30, and with the same mechanism the unidirectional movement of the wrench body 10 in the clockwise direction may act to loosen the nuts or bolts.

Figure 9:
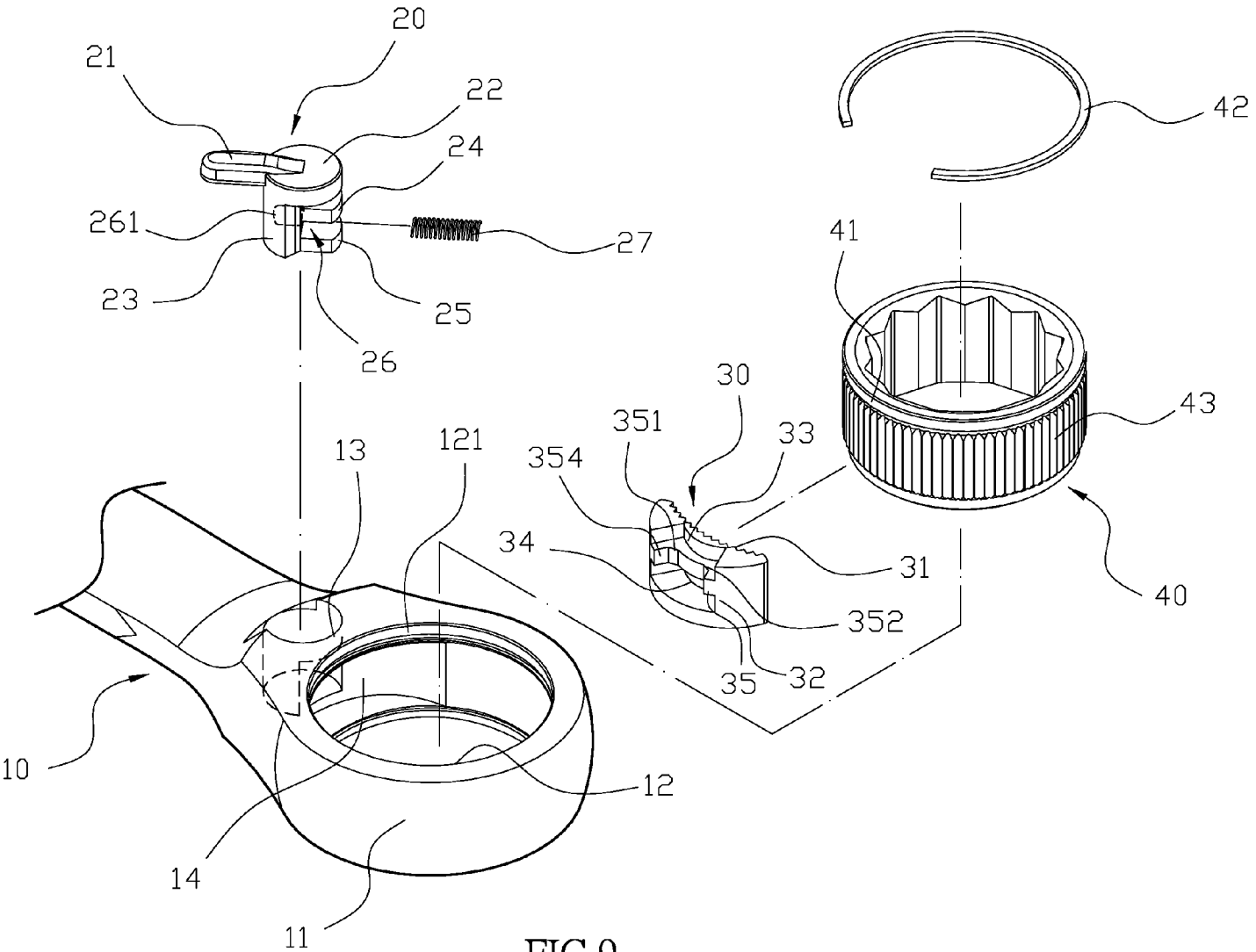
FIG. 9 is an exploded view of another embodiment of the reversible ratchet wrench of the present invention.
Figure 10:
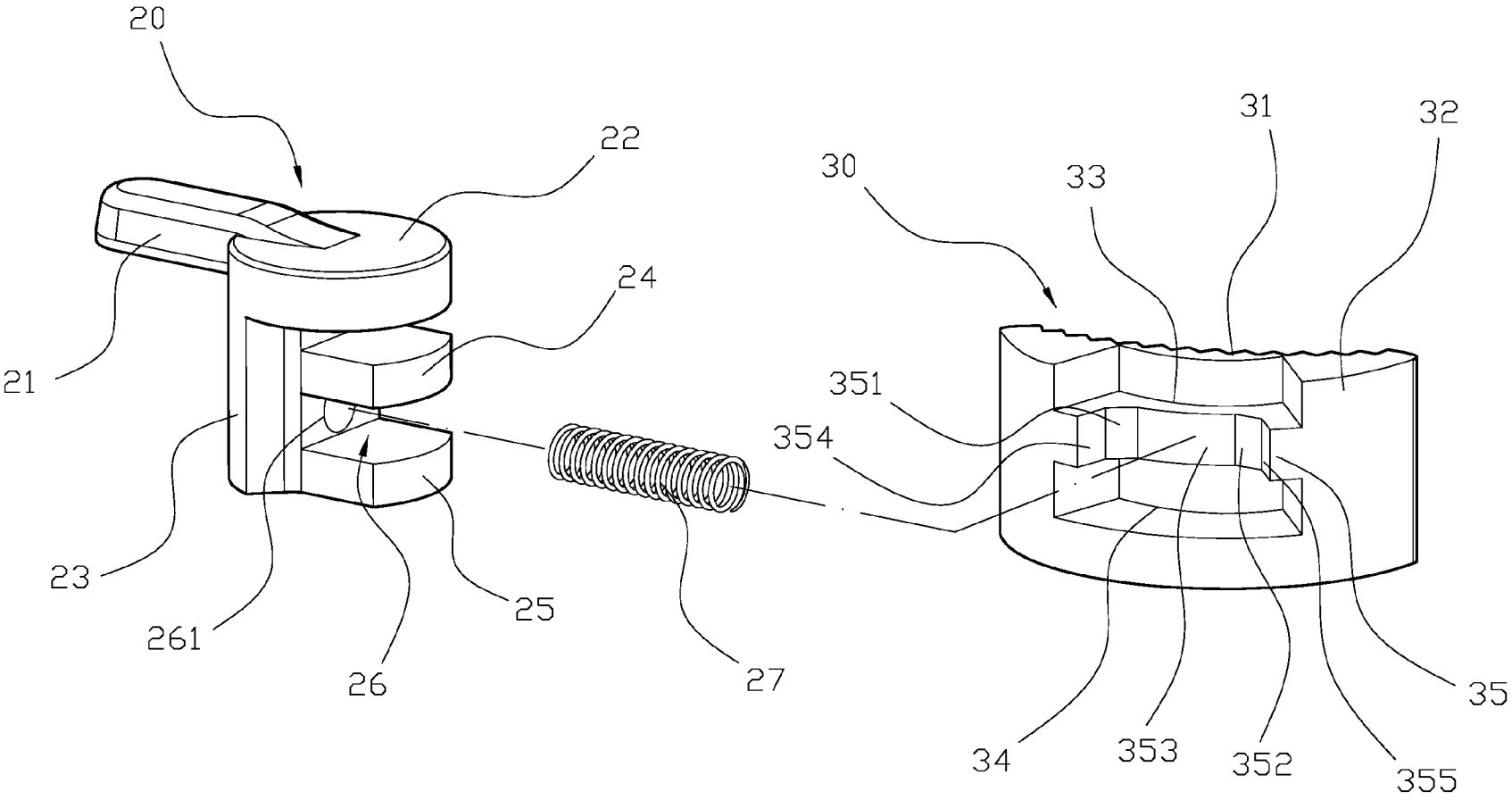
FIG. 10 is an exploded view of the another embodiment of the reversible ratchet wrench (II) of the present invention.
Figure 11:
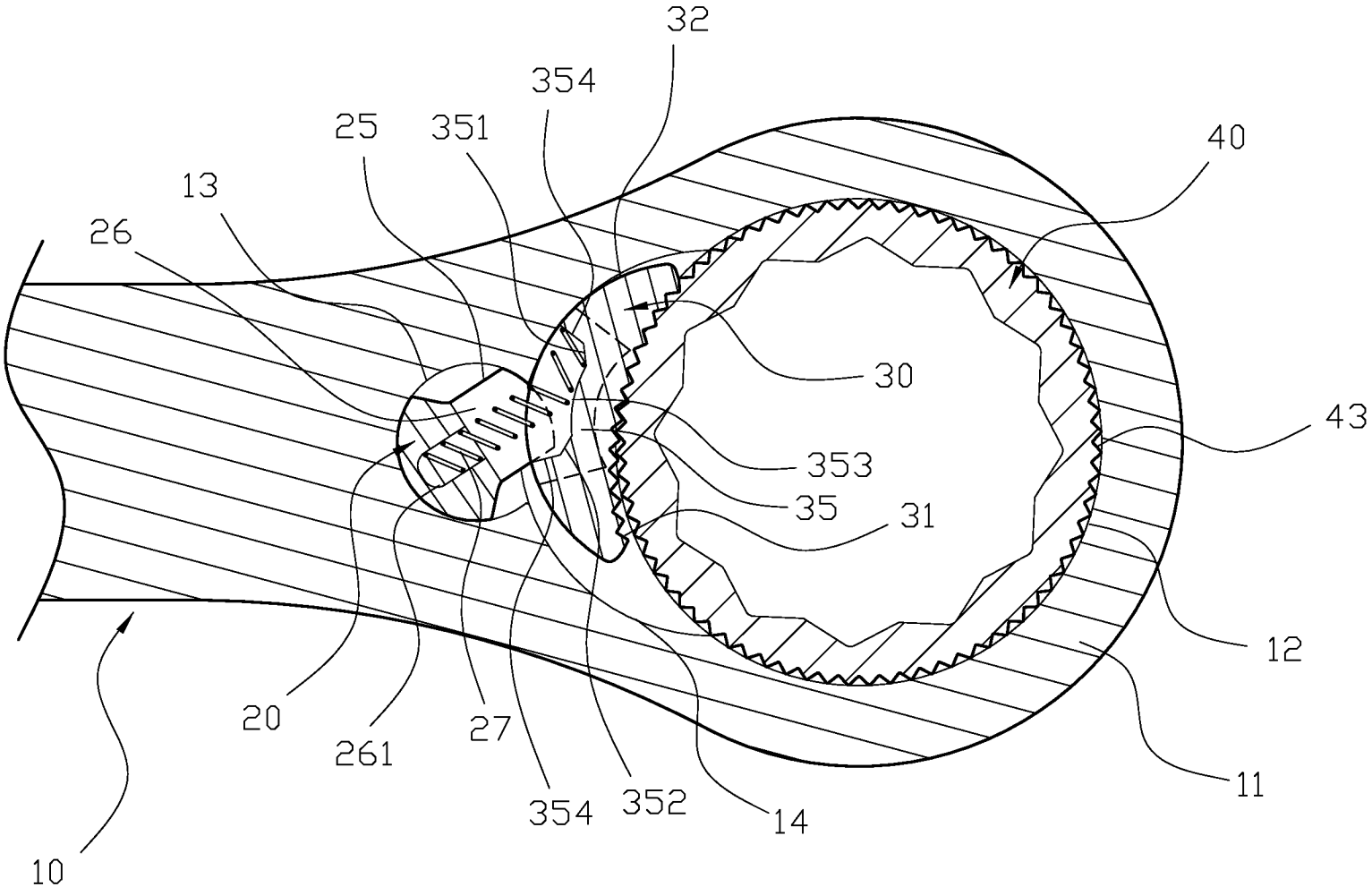
FIG. 11 is a sectional view of another embodiment of the reversible ratchet wrench (II) of the present invention.
Figure 12:
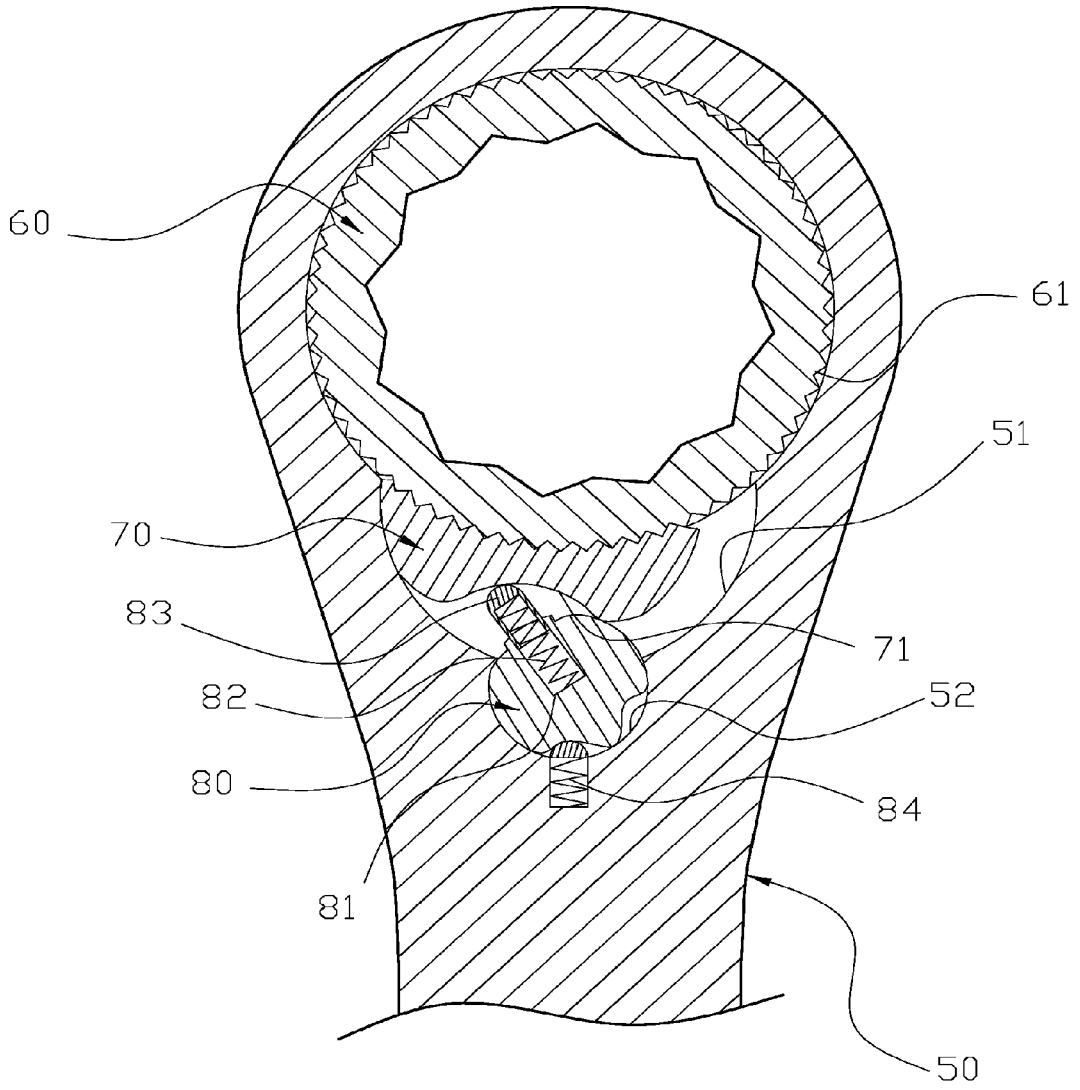
FIG.12 PRIOR ART
FIG. 12 is a sectional view of a conventional ratchet wrench.

Another embodiment of novel reversible ratchet wrench of the present invention is shown in FIGS. 9 to 11. In this specific embodiment, the restricting block 35 is recessed, and has an arc-shaped convex surface 353 in the center of the recessed portion, two symmetrical recessed surface 351 (352) located on both sides of the arc-shaped convex surface 353, and two stopper planes 354(355) located at the further outsides of the two symmetrical recessed surfaces 351(352). The two stopper planes 354(355) also function in restricting the positioning of the spring 27 during the switch of the direction of rotational movement of the wrench body 10, and the arc-shaped convex surface 353 allows the spring 27 to move at an accelerated speed towards either of the two symmetrical recessed surface 351(352) after it passes the arc-shaped convex surface 353, thereby increasing speed of the switch of the control member 20 for a specific unidirectional movement as well as increasing the smoothness of the switching operation.

With the above-mentioned structural characteristics and technical improvements, the novel reversible ratchet wrench has the following advantages over conventional ratchet wrenches. Firstly, the structural design allows sufficient secure positioning of the control member 20, the ratchet member 30, and the spring 27. As previously described, the control member 20 of the novel ratchet wrench has the first and the second stopper planes 24(25) located at both sides of the restricting slot 26, the spring 27 is placed into the deep hole 261 located in the body of the half cylindrical body 23 of the control member 20 corresponding to the location of the restricting slot 26, the half cylindrical column of the control member 20 is placed into the round hole 13 of the wrench body 10, and the ratchet member 30 is placed into the arc-shaped slot 14 and properly connected to the control member 20. When the control member 20 and the ratchet member 30 are properly installed, the restricting block 35 of the ratchet member 30 is placed into the restricting slot 14 of the control member 20, the first stopper plane 24 of the control member 20 is placed into the first slot of the ratchet member 30, and the second stopper plane 25 of the control member 20 is placed into the second slot of the ratchet member 30, which not only form a secure position limiting effect to the control member 20, but effectively prevents the spring 27 from ejecting out of its position or getting stuck by restricting the moving space of the spring 27 through enclosing the spring 27 with the first stopper plane 24, the second stopper plane 25, and the two symmetrical recessed surfaces 351(352) of the restricting block 35. This structural design also improves the smoothness of switching operation between different directions of the unidirectional rotational movement of the wrench body 10. Therefore, the novel reversible ratchet wrench of the present invention is durable and flexible for practical uses. Secondly, the wrench body 10 of the novel reversible ratchet wrench has a round hole 13, an arc-shaped ratchet slot 14, and an operation opening 12, wherein the control member 20 and the spring 27 is interposed though the round hole 13, and the positioning of the control member 20 is limited by the ratchet member 30. Furthermore, the rotating member 40 is fixed by the C-shaped fastening member 42 to the operation opening 12 of the wrench body 10. This structure thus allows quick and convenient installation of the components, reduces the number of components required, and simplifies the manufacturing processes of these components. Thirdly, the restricting block 35 has two symmetrical recessed surfaces 351(352) facing the control member 20, thereby the direction of the rotational movement of the wrench body 10 can be readily adjusted by switching between the two surfaces 351/352 against which the spring 27 pushes. Furthermore, the restricting block 35 of the ratchet member 30 may have an arc-shaped convex surface 353 between the two symmetrical recessed surfaces 351/352, which functions to increase the speed of the switch between directions of the rotational movement of the wrench body 10 as the spring slides at an accelerated speed towards the recessed surfaces 351/352 after it passes the arc-shaped convex surface 353. This design also increases the smoothness of the switching operation. And fourthly, the restricting block 35 of the ratchet member 30 may also have two stopper planes 354/355 located at the further outer side of each of the two symmetrical recessed surfaces 351/352, which further enhances the position limiting effect to the spring 27 in addition to the existing structures.

To summarize, the present invention describes a novel reversible ratchet wrench with a breakthrough in structural design, further improved new components, and advantages in practical use and commercial exploration. The present invention has not been disclosed in any published materials and thus possesses novelty.

The above description and illustrations are for one exemplary embodiment of the present invention and should not be considered to limit the scope of the implementation of the present invention. Accordingly, the present invention is not to be considered as limited by the forgoing description, but includes any equivalents.

What is claimed is:

1. A reversible ratchet wrench, comprising:

a wrench body, wherein one end of the wrench body is a ratchet portion, and the ratchet portion has a operating opening and a round hole, and the operating opening and the round hole is connected via an arc-shaped ratchet slot;

a control member, wherein the control member has a shank portion and a round plate formed at the end of the shank portion, the round plate extending to one direction with a half cylinder, and the control member being placed into the round hole of the wrench body with the half cylinder, wherein the half cylinder has the first and second stopper planes which protrude towards the ratchet member and both are parallel to the round plate, and a restricting slot that is therefore formed between the first and the second stopper planes, wherein a deep hole is disposed into the body of the half cylindrical column at the position of the restricting slot and a spring is placed into the hole, with the first stopper plane, the second stopper plane, and the spring all pointing towards the arc-shaped ratchet slot;

a ratchet member, wherein one side of the ratchet member has an arc-shaped toothed surface that is inwardly recessed and faces the operation opening, and on the other side an arc-shaped smooth surface which allows the surface to slide against the inner surface of the arc-shaped ratchet slot, wherein center area of ratchet member is carved to form a first and a second slots, and a bulged restricting block between the first and the second slots, and when the restricting block of the ratchet member is placed into the restricting slot of the control member, the first stopper plane of the control member is placed into the first slot of the ratchet member, and the second stopper plane of the control member is placed into the second slot of the ratchet member to form a secure positioning between the control member and the ratchet member, and the restricting block of the ratchet member is recessed and is pushed against by one end of the spring; and a rotating member, wherein the rotating member is placed into the operation opening of the wrench body, and outer surface of the rotating member is a toothed ring gear structure, and surface of the toothed ring gear is configured to remain intermeshed with the arc-shaped toothed surface of the ratchet member when the ratchet member is being pushed by the spring.

2. The reversible ratchet wrench of the claim 1, wherein the operation opening of the reversible ratchet wrench has a fixing slot at the top edge of the inner surface of the operation opening, and the rotating member has a concaved slot at the corresponding place located at the outer surface of the cylindrical body of the rotating member, a C-shaped elastic fastening member that is fitted into both of the two slots and secure the connection between the rotating member and the wrench body.

3. The reversible ratchet wrench of the claim 1, wherein the restricting block of the ratchet member has two symmetrical recessed surfaces that face towards the control member and is pushed against by the spring, and the direction of the rotational movement of the wrench body is determined by selecting either of the two symmetrical recessed surfaces to be pushed against by the spring.

4. The reversible ratchet wrench of the claim 3, wherein the restricting block of the ratchet member has an arc-shaped convex surface between the two symmetrical recessed surfaces, which functions to increase the speed of the switching operation between the two different directions of the rotational movement of the wrench body.

5. The reversible ratchet wrench of the claim 4, wherein the restricting block of the ratchet member has two stopper planes with each located at an outer side of one of the symmetrical recessed surfaces, which further enhances the position limiting effect to the spring.

* * * * *